US008668536B1

(12) United States Patent
Burnham

(10) Patent No.: US 8,668,536 B1
(45) Date of Patent: Mar. 11, 2014

(54) PEDAL POWERED BOAT USING A FISH TAIL PADDLE

(76) Inventor: Steve Burnham, Havana, FL (US)

( * ) Notice: Subject to any disclaimer, the term of this patent is extended or adjusted under 35 U.S.C. 154(b) by 0 days.

(21) Appl. No.: 13/586,014

(22) Filed: Aug. 15, 2012

(51) Int. Cl.
*B63H 16/08* (2006.01)

(52) U.S. Cl.
USPC ..... 440/15; 440/21; 440/24

(58) Field of Classification Search
USPC ..... 114/153; 440/15, 21, 24
See application file for complete search history.

(56) References Cited

U.S. PATENT DOCUMENTS 2,654,335 A * 10/1953 Ball ..... 114/153
2,668,513 A 2/1954 Reynolds
3,139,061 A 6/1964 Johnston
3,880,107 A 4/1975 Miles
4,960,396 A 10/1990 Stolzer
5,000,706 A 3/1991 Wang
5,163,857 A 11/1992 Hinsley
5,584,732 A 12/1996 Owen
5,921,824 A * 7/1999 Ilagan ..... 440/26
5,938,489 A 8/1999 McNeil

* cited by examiner

*Primary Examiner* — Stephen Avila
(74) *Attorney, Agent, or Firm* — Peter Loffler

(57) ABSTRACT

A fish tail propelled water vessel uses a pair of back and forth reciprocating pedals to rotate a flywheel back and forth, the paddle blade of the vessel attached to the flywheel so that the reciprocating flywheel swishes the blade through the water in side to side fashion thereby propelling the vessel. A cable attaches each pedal to its respective side of the flywheel in order to cause rotation of the flywheel. A pedal cable helps balance the pedals thereby assuring smooth pedaling of the device. Holding one of the pedals forward of the alignment point with the other pedal, holds the blade to that side, thereby steering the vessel to the opposing side.

26 Claims, 6 Drawing Sheets

PEDAL POWERED BOAT USING A FISH TAIL PADDLE

BACKGROUND OF THE INVENTION

1. Field of the Invention

The present invention relates to a human powered boat wherein a seated operator uses a pair of reciprocating pedals that power a side to side swishing fish tailed paddle, wherein the paddle is used for both propulsion of the vessel as well as steering of the vessel.

2. Background of the Prior Art

A pedal boat is a human powered water vessel that is typically used near shore and is often used where motorized boats are not appropriate such as in creeks, shallow draft rivers, small lakes or where regulations prohibit the use of motorized watercraft. These relatively small vessels are great for all kinds of activities including fishing, picnicking, and water photography, among many other uses. As a pedal boat is much more stable relative to its kayak and even canoe brethren, it is not unusual to see families with small children take to the water for a day of fun. As locomotion of the pedal boat is provided by one or more of the passengers of the boat, these vessels are also a good source of exercise.

Typically, a pedal boat is comprised of a pair of pontoons with seating overtop and between the pontoons, with the shell of the boat being made from an upper and a lower plastic form attached to each other. Foot pedals (occasionally some pedal boats have hand pedals) are located for access by the front seat passengers who rotatably pedal the pedals to make the boat move, forward pedaling for forward movement and reverse pedal for reverse movement. An axle that connects the left and right pedal pairs of the front passengers has a multi blade paddle wheel thereon that scoops through the water. Pedaling of the pedals rotates the axle, which rotates the blades of the paddle through the water in order to move the vessel. A tunnel between the seats provides the clearance for the rotating paddle. Typically a small handle is linked to a rudder that steers the boat. This basic design results in a low cost boat that provides hours of enjoyment.

A drawback of the typical pedal boat lies in the fact that, due to size constraints, the tunnel within which the paddle rotates, is relatively small, so that the paddle wheel itself is relatively small. A small paddle wheel means that even with rigorous pedaling of the pedals, only very slow speeds are obtained. While acceptable to some, many pedal boat operators want speed as well as a more rigorous workout than can be achieved with limited sized paddle wheels.

In order to address these concerns, some human powered boats rely on a fish tail paddle instead of the rotating paddle wheel found on the pedal boats described above. In a fish tail propulsion system, a single blade that is normally aligned with the central longitudinal axis of the vessel, is placed in the water and is swung side to side much like the tail of a fish in order to provide propulsion for the vessel. As such fish tail paddles are often located aftward of the hull of the vessel, their size if much less constrained relative to an under hull paddle wheel, so that relatively large paddles can be used. The use of a large paddle requires substantial energy from the operator in order to swing the paddle back and forth so that a rigorous workout can be achieved. Additionally, the large paddle can generate speeds for the vessel that are greater relative to the possible speed of a paddle wheel pedal boat.

While fish tail paddle powered boats are preferred by many relative to paddle wheel pedal boats, the fact that the blade of these boats goes from side to side, as opposed to continually in a circle in the case of paddle wheel blades, the mechanical architecture tends to be much more complex. This often results in the requirement that a substantial portion of the available real estate of the vessel is occupied by the propulsion system. Additionally, this complexity makes such boats more expensive to purchase as well as to maintain. Additionally, many fish tail paddle vessel operators complain that the articulation mechanism used to swing the paddle is jerky or otherwise not smooth, especially at the end of each pedal cycle.

What is needed is a human powered water vessel that uses a side to side swishing fish tail paddle configuration, that addresses the above stated problems. Specifically, such a vessel must be relatively simple in design and construction so as to be readily affordable to potential purchasers of this type of device. Such a vessel must be able provide a rigorous workout to an operator of such a vessel that desires a workout, all while allowing relatively strong speeds through the water. Powering the vessel by the operator must be relatively smooth across the entire pedaling cycle.

SUMMARY OF THE INVENTION

The pedal powered boat using a fish tail paddle of the present invention addresses the aforementioned needs in the art by providing a water vessel that uses a paddle, aligned with the central longitudinal axis of the vessel and located aftward along the hull structure along this longitudinal axis, wherein side to side reciprocation of the paddle, in a fish tail manner, provides propulsion for the vessel, such paddle reciprocation in response to forward and aft reciprocation of a set of pedals used by the operator. The pedal powered boat using a fish tail paddle is of relatively simple design and construction so that it is relatively inexpensive to produce, using standard manufacturing techniques. This makes the pedal powered boat using a fish tail paddle available at price points that many consumers of such devices find very attractive. The entire power movement cycle provided by the operator of the pedal powered boat using a fish tail paddle is smooth across the entire pedal reciprocation cycle and lacks the jerks often experienced by operators of prior art fish tail devices. The pedal powered boat using a fish tail paddle is designed so as to not unduly occupy real estate on board the vessel.

The pedal powered boat using a fish tail paddle of the present invention is comprised of a vessel that has a forward end and an aft end joined by a port side and a starboard side with a longitudinal midline axis passing through the vessel between the forward end and the aft end. A paddle structure is attached to the vessel and is capable of pivoting about a vertical axis that passes through the midline axis such that a paddle blade of the paddle structure is capable of radially swishing back and forth on either side of the midline axis. A port pedal structure is attached to the vessel on the port side of the midline axis and has a port pedal that is capable of reciprocating back and forth toward the forward end and the aft end while a starboard pedal structure is attached on the starboard side of the midline axis and has a starboard pedal that is capable of reciprocating back and forth toward the forward end and the aft end. The port pedal structure and the starboard pedal structure are located equidistant to the midline axis on their respective side of the midline axis and the port pedal and the starboard pedal are, when aligned with one another, located equidistant from the forward end of the vessel. A first cable has a first end attached to the port pedal structure and a second end attached to the paddle structure to the port of the vertical axis while a second cable has a third end attached to the starboard pedal structure and a fourth end attached to the paddle structure to the starboard of the vertical axis. Whenever the port pedal and the starboard pedal are aligned, the paddle blade is located on the midline axis. As the port pedal and the starboard pedal are each reciprocated back and forth in opposing direction to one another, the paddle blade swishes back and forth. A pulley is located on the midline axis and forward of the port pedal structure and the starboard pedal structure. A third cable has a fifth end attached to the port pedal structure and a sixth end attached to the starboard pedal structure such that the third cable passes over the pulley. The port pedal structure has a port radial guide with a first radial groove thereon while the starboard pedal structure has a starboard radial guide with a second radial groove such that the first cable passes through the first groove, the second cable passes through the second groove and the third cable passes through both the first groove and the second groove. The paddle structure is comprised of a flywheel that has a half-moon shaped power guide with a third groove on its outer radial edge and a connector bar that forms the base of the power guide such that a first pin passes through the connector bar in order to pivotally attach the paddle structure to the vessel. An outrigger structure is connected to and extends rearwardly from the connector bar in a direction opposite to the direction of the power guide. A second pin attaches the paddle blade to the outrigger structure. The outrigger structure is pivotally attached to the connector bar and is capable of pivoting between a raised position and a lowered position such that when the outrigger structure is in the lowered position, the outrigger structure rests on a lip located on a tail that extends from the connector bar. A first resilient member connects the second pin with the outrigger structure to the port of the midline axis whenever the paddle blade is on the midline axis while a second resilient member connects the second pin with the outrigger structure to the starboard of the midline axis whenever the paddle blade is on the midline axis. The first resilient member may be a first spring or a first resilient cord or both while the second resilient member may be a second spring or a second resilient cord or both. The paddle blade is capable of being rotated 180 degrees in order to change direction of propulsion created by the paddle blade. A seat is located on the vessel such that the seat is positioned so as to allow an operator sitting in the seat to be able to reach the port pedal structure and the starboard pedal structure and reciprocate the two pedals.

BRIEF DESCRIPTION OF THE DRAWINGS

Similar reference numerals refer to similar parts throughout the several views of the drawings.

DESCRIPTION OF THE PREFERRED EMBODIMENT

Figure 1:
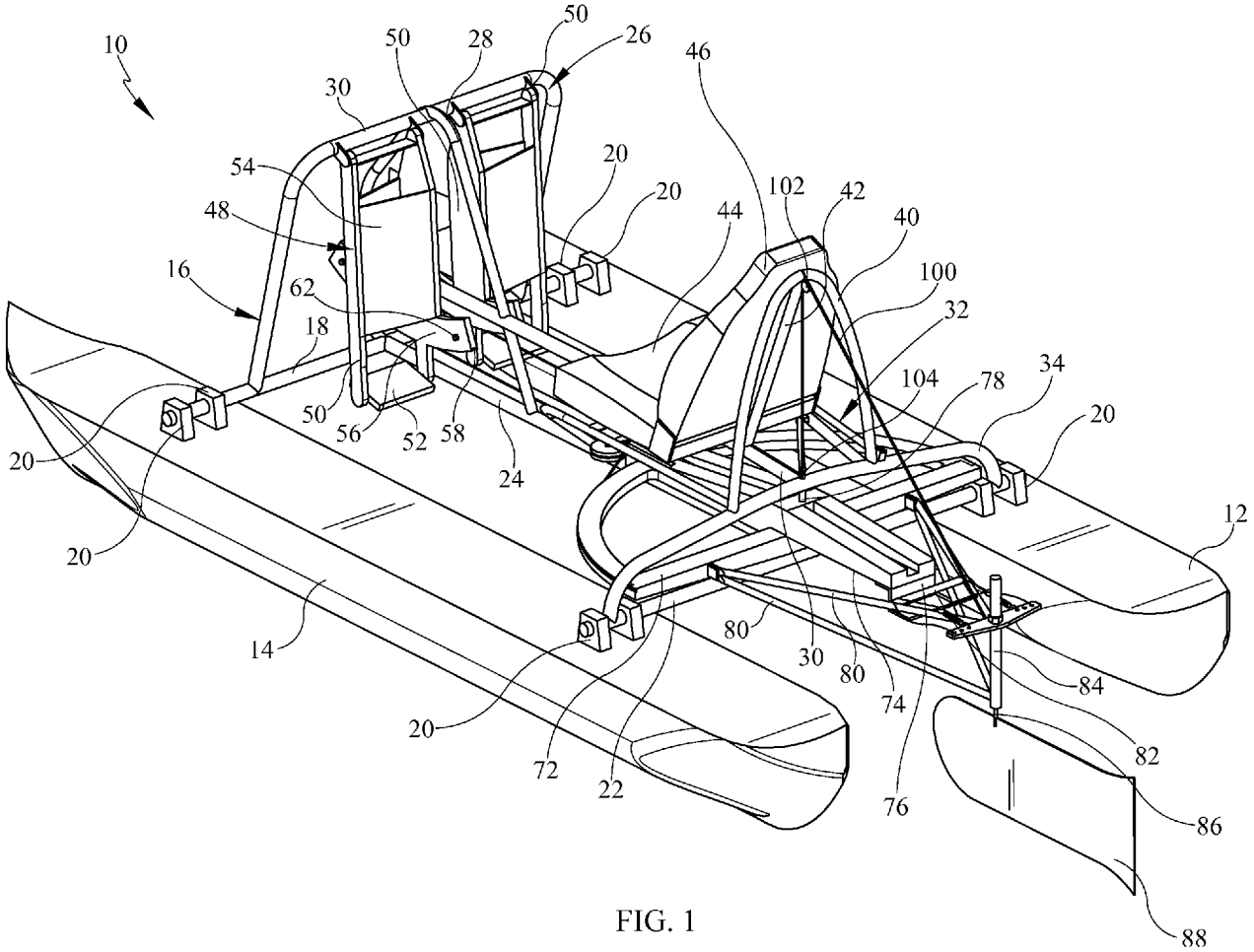
FIG. 1 is a rear perspective view of the pedal powered boat using a fish tail paddle of the present invention.
Figure 2:
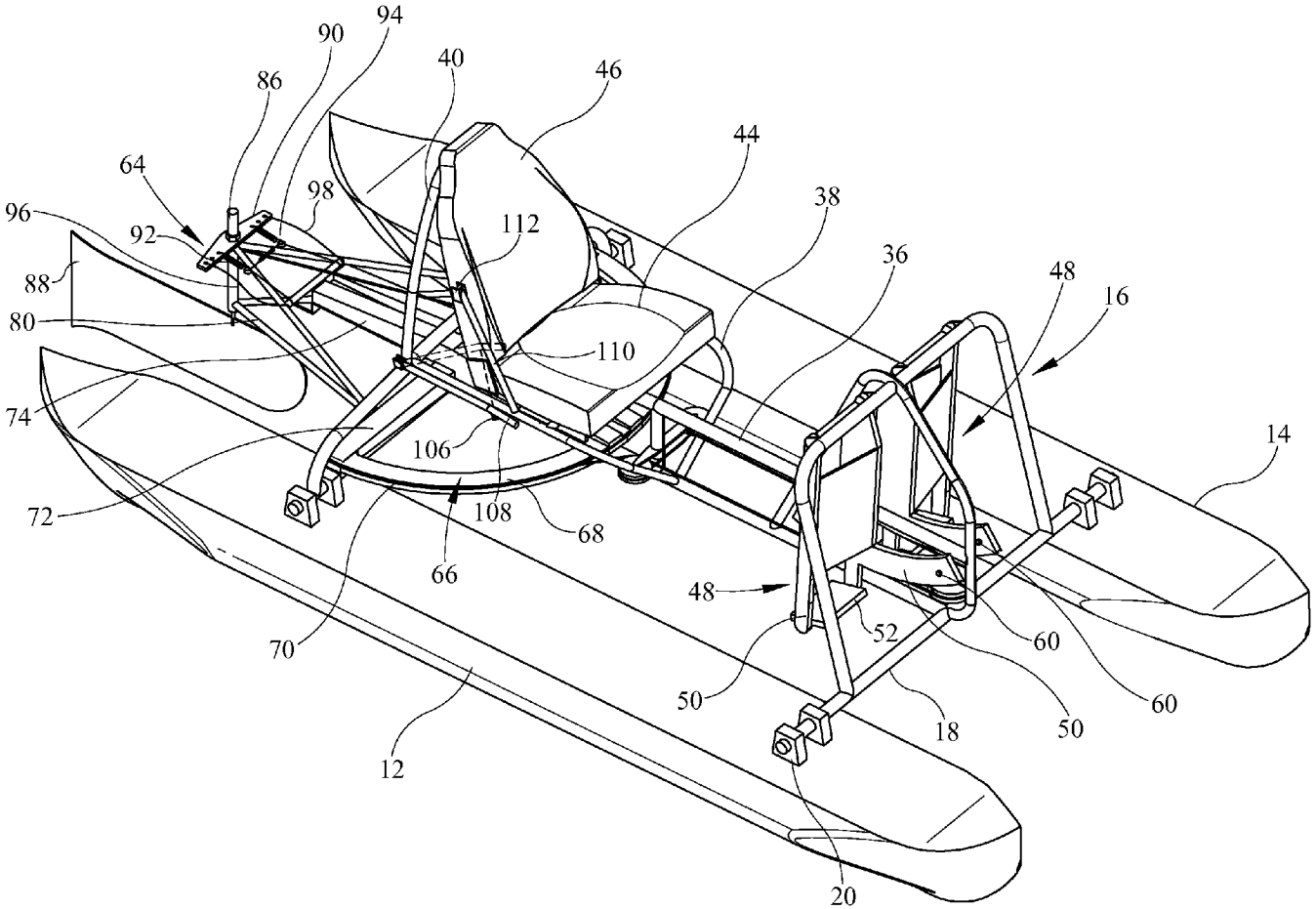
FIG. 2 is a front perspective view of the pedal powered boat using a fish tail paddle.
Figure 3:
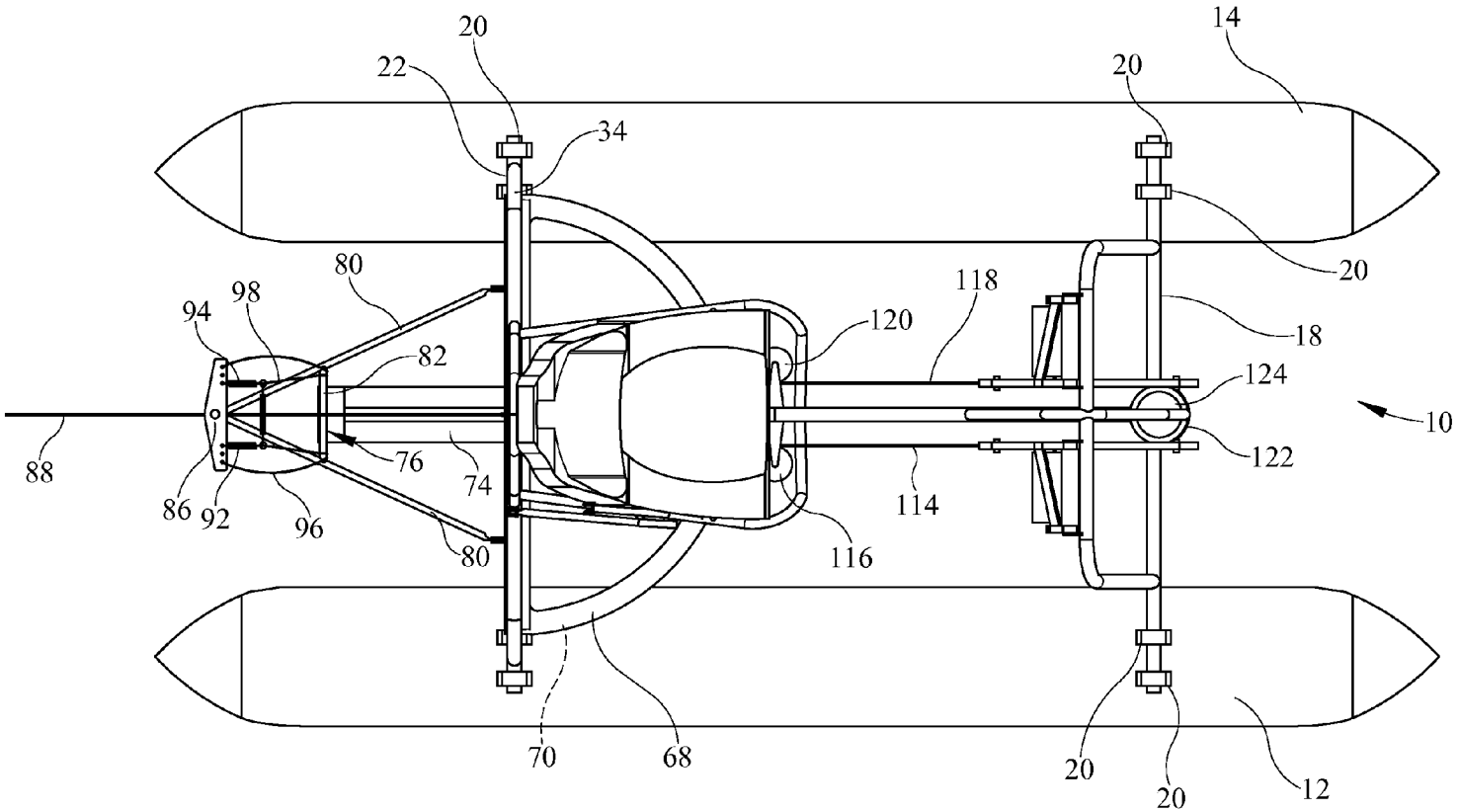
FIG. 3 is a top plan view of the pedal powered boat using a fish tail paddle.
Figure 4:
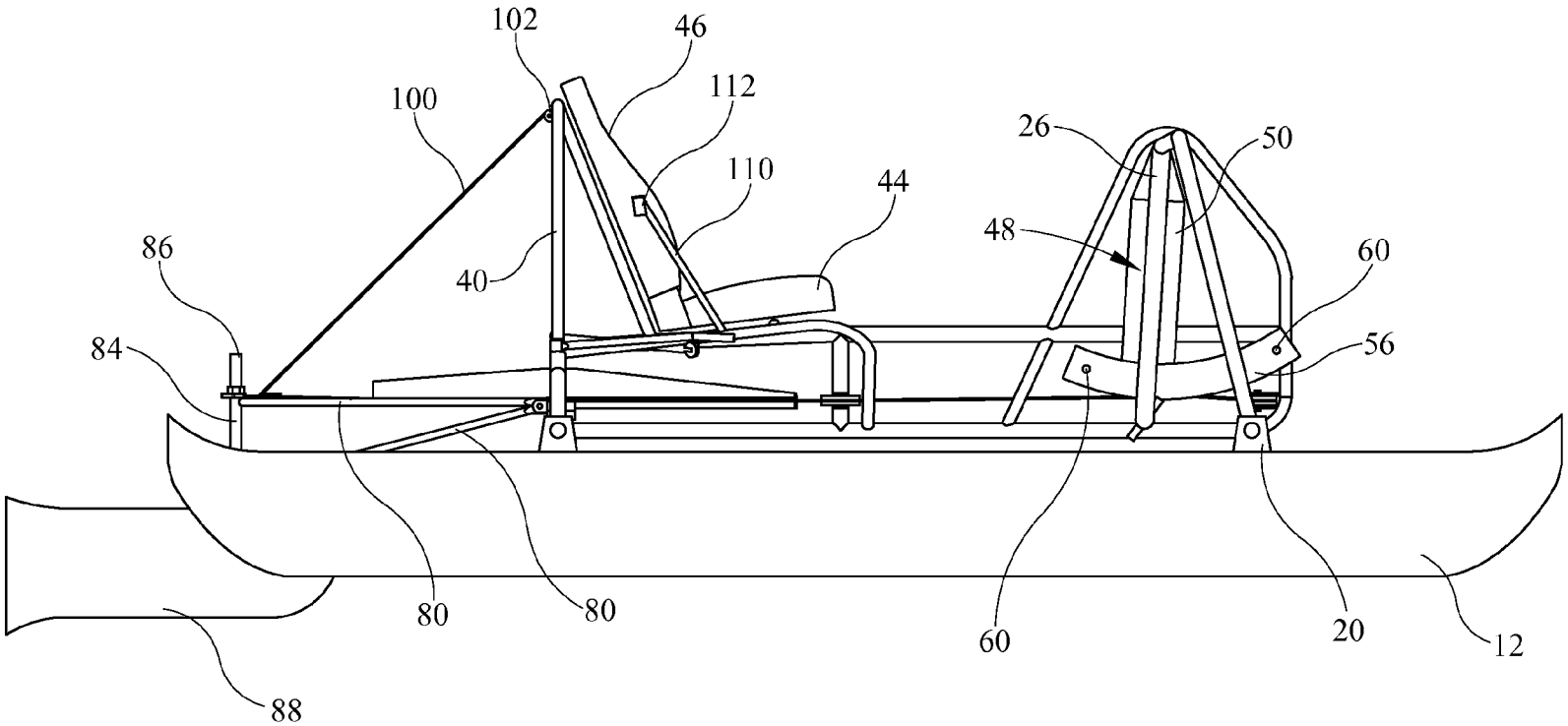
FIG. 4 is a side view of the pedal powered boat using a fish tail paddle.
Figure 5:
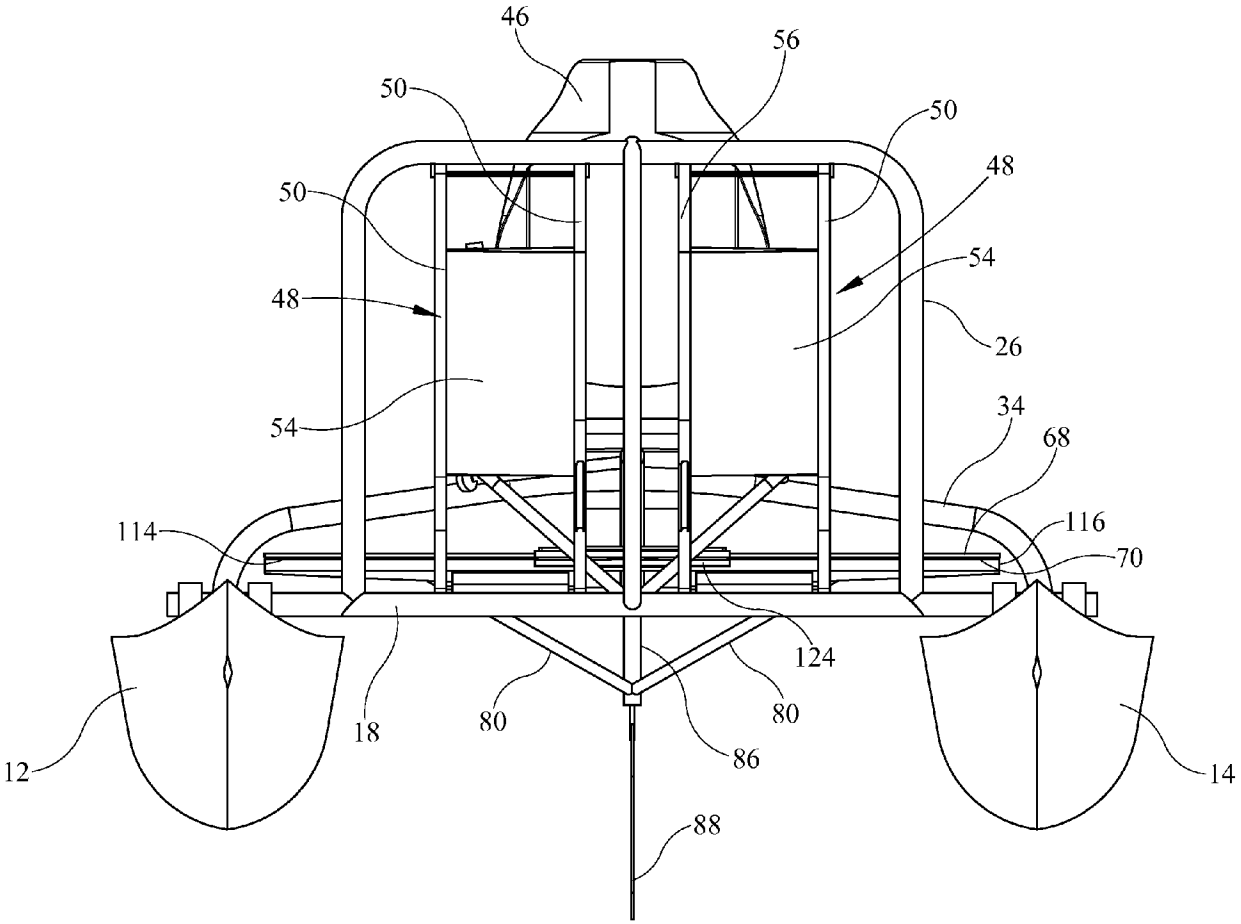
FIG. 5 is a front elevation view of the pedal powered boat using a fish tail paddle.
Figure 6:
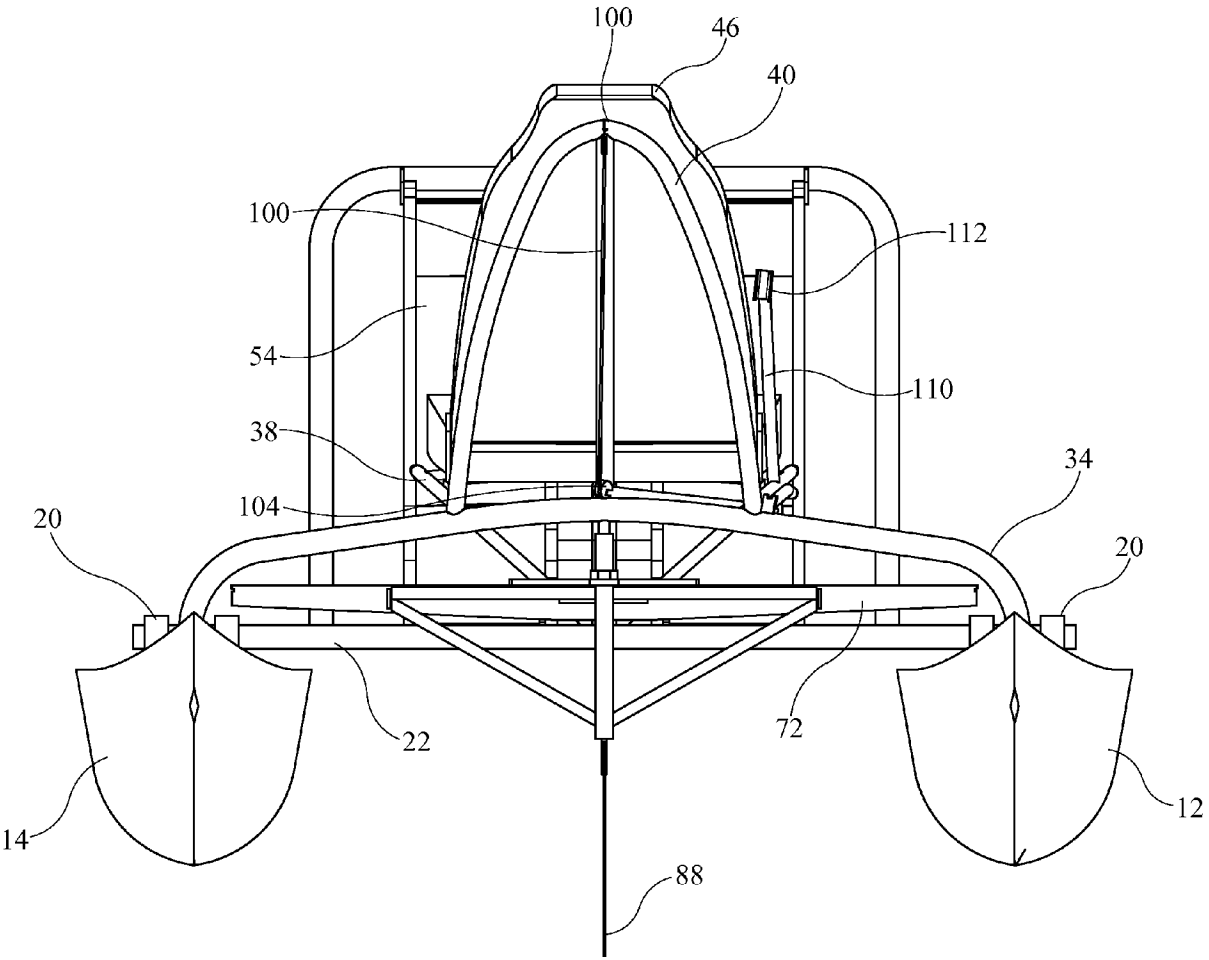
FIG. 6 is a rear elevation view of the pedal powered boat using a fish tail paddle.

Referring now to the drawings, it is seen that the pedal powered boat using a fish tail paddle of the present invention, generally denoted by reference numeral 10, is comprised of a pair of pontoons of appropriate construction, namely a starboard pontoon 12 and a port pontoon 14, joined by a frame superstructure 16. It is expressly recognized that while the foregoing description is directed at a pontoon structure, the present invention works equally well when installed on other water vessels such as traditional V-hulled boats.

As seen, the frame superstructure 16 has a forward connection bar 18 that is attached to the pair of pontoons 12 and 14 via appropriate fasteners 20 and an aft connection bar 22 that is also attached to the pair of pontoons 12 and 14 via fasteners 20. A connection bridge 24 extends between the forward connection bar 18 and the aft connection bar 22. A forward mast 26 extends upwardly from the forward connection bar 18 on either side of the midline of the vessel 10, the forward mast 26 having one or more braces 28 connecting the forward mast's horizontal leg 30 with the connection bridge 24.

A seating sub-frame 32 has an aft mast 34 that rises from the aft connection bar 22 while a seat rail 36 extends from the midpoint of the aft mast 34 and connects to either the connection bridge 24, to one of the braces 28 or both. A pair of side rails 38 extends from either side of the connection bridge 24 and connects with the aft mast 34 on either side of aft mast's midpoint. A riser 40 extends upwardly from the aft mast 34 and may have a brace 42 that connects the riser 40 with the seat rail 36. A seat 44 with back 46 is attached to the seat rail 36 and to the side rails 38 in appropriate fashion and may have appropriate means (not illustrated) of any appropriate design known in the art for adjusting the seat 44 either forward or aftward depending on the needs of the user.

A pair of pedal structures 48 is provided such that each pedal structure 48 is pivotally attached to the forward mast 26 on either side of the midpoint of the forward mast 26. As seen, each pedal structure 48 comprises a pair of down rails 50 that are each pivotally attached to the forward mast 26 such that a foot rest 52 connects the distal ends of the down rails 50, the foot rests 52 being rotatable. A splash guard 54 may connect the pair of down rails 50. A cable guide 56 having a groove 58 on its outer radius is attached to the inner down rail 50 of each pedal structure 48. Each cable guide 56 has a forward attachment point 60 and a rearward attachment point 62.

A paddle structure 64 is provided and comprises a flywheel 66 that has a half-moon rail 68 with a groove 70 on the outer radius thereof. A connector bar 72 connects the ends of the half-moon rail 68 while a tail 74 extends rearwardly from the midpoint of the connector bar 72, the end of the tail 74 having a lip 76 (the tail 74 may also extend to the midpoint of the half-moon rail 68 as shown). The flywheel 66 is rotatably attached to the seating sub frame 32, by passing a pin 78 through the connector bar 72 and the tail 74 such that the pin is attached to the midpoint of the aft connection bar 22 and to the aft mast 34, allowing the flywheel 66 to rotate back and forth about the pin 78. Two sets of outrigger bar 80 pairs are pivotally attached to the connector bar 72 on either side of the tail 74 and have a cross bar 82 extending between the lower outrigger bars 80 towards their distal ends. A holding tube 84 is attached to the distal ends of the outrigger bars 78. A blade pin 86 is rotatably held within the holding tube 84 and has a blade 88 located on the end thereof. A wing structure 90 is attached to the blade pin 86 while a first spring 92 extends between one of the wings of the wing structure 90 and the upper outrigger bar 80 on one side of the vessel 10 while a second spring 94 extends between the other wing and the other upper outrigger bar 80. Similarly, a first cable 96 (which may be resilient (bungee, etc.,)) extends between one of the wings of the wing structure 90 and the upper outrigger bar 80 on one side of the vessel 10 while a second similar cable 98 extends between the other wing and the other upper outrigger bar 80. Advantageously, the springs 92 and 94 and the cables 96 and 98 are attached to their respective points on the wing structure 90 so as to be readily detached therefrom and reattached in similar rapid fashion.

A lift cable 100 has an end attached to the holding tube 84 and passes over an upper pulley 102 located at the top of the riser 40, over a lower pulley 104 located on the aft mast 34 and over a handle pulley 106 and is attached to a handle 108, the handle 108 being pivotally attached to the aft mast 34. A holder 110 having a saddle 112 on its upper end extends upwardly from the side rail 38 that is proximate to the handle 108.

A starboard drive cable 114 has a first end attached to the forward attachment point 60 of the cable guide 56 located on the starboard side pedal structure 48 and a second end attached to the flywheel 66 at a point on the starboard side of the half-moon rail 68 proximate the connector bar 72. The starboard drive cable 114 passes through the groove 58 of its respective cable guide 56, over a starboard guide pulley 116 attached to the starboard side rail 38, and through the groove 70 of the half-moon rail 68. Similarly, a port drive cable 118 has a first end attached to the forward attachment point 60 of the cable guide 56 located on the port side pedal structure 48 and a second end attached to the flywheel 66 at a point on the port side of the half-moon rail 68 proximate the connector bar 72. The port drive cable 118 passes through the groove 58 of its respective cable guide 56, over a port guide pulley 120 attached to the starboard side rail 38, and through the groove 70 of the half-moon rail 68. A pedal cable 122 has one end attached to the rearward attachment point 62 of one of the cable guides 56 and an opposing end attached to the rearward attachment point 62 of the other cable guide 56, the pedal cable passing through the grooves 58 of each cable guide 56 and over a pedal pulley 124 attached to the forward mast 26.

The various components of the frame superstructure 16 are made from an appropriate strong material such as aluminum tubing. If desired, the flywheel 66 may be made from steel in order to give the flywheel 66 additional mass which helps with certain types of pedaling.

In operation of the pedal powered boat using a fish tail paddle 10, whenever the pedal structures 48 are aligned with one another (foots rests 52 even in side by side relationship), the flywheel 66 is symmetric down the midline of the vessel 10 such that the tail 74 points straight back. This assures that the blade 88 is aligned along the longitudinal axis of the vessel 10. A user uses the pedal structures 48 to both move and steer the vessel 10. When the user pushes the starboard pedal structure 48 forward, the starboard drive cable 114 is pulled forward, causing the flywheel 66 to rotate (counterclockwise in FIG. 1). The rotation of the flywheel 66 causes the port drive cable 118 to be pulled back which causes the port side pedal structure 48 to pivot back toward the user. Once the starboard side pedal structure 48 is at maximum extension, the user then pushes the port side pedal structure 48 forward, causing a pull on the port drive cable 118, thereby changing the direction of rotation of the flywheel 66 (now clockwise in FIG. 1), and the starboard side pedal structure 48 to be pulled back toward the user. Once the port side pedal structure 48 is at maximum extension, the user then once again pushes the starboard side pedal structure 48 forward, causing a pull on the starboard drive cable 118, thereby again changing the direction of rotation of the flywheel 66. The user keeps pedaling in this manner. As the blade 88 is attached to the flywheel 66, the back and forth rotation of the flywheel 66 causes the blade 88 to swish back and forth in lock step, thereby propelling the vessel 10 through the water. The pedal cable 122 keeps the two pedal structures 48 balanced in position with one another thereby assuring smooth pedaling. In order to turn the vessel 10, then either the pedal structure 48 on the side opposite the side to which a turn is desired is held forward, in order to keep the blade 88 on this opposite side (keep starboard pedal structure 48 in the forward position keeps the blade 88 on the starboard side of the longitudinal axis of the vessel 10, turning the vessel 10 to port), or the user pushes more on the starboard side pedal structure 48 (starboard side pedal structure is more forward than aftward of alignment with the opposite pedal structure 48) in order to turn the vessel 10 to port. As the blade 88 is rotatable within the holding tube 84, the blade 88 has a tendency to twist in other than straight forward operation of the vessel. The springs 92 and 94 dampen such twisting and return the blade 88 to the center line while the cables 96 and 98 limit the amount of twisting. Although the springs 92 and 94 can be used for limiting blade 88 twist, the use of separate cables 96 and 98 helps prevent premature fatigue of the springs 92 and 94. If reverse direction of travel of the vessel 10 is desired, then the springs 92 and 94 and the cables 96 and 98 are disconnected from the wing structure 90 and the blade 88 is rotated 180 degrees and the springs 92 and 94 and cables 96 and 98 are reattached to the wing structure 90—the rotation of the blade 88 can be accomplished in any known fashion such as having the blade pin 86 locked in position by a lock nut (not illustrated), having some form of spring loaded tongue and groove structure within the hold tube 84 (also not illustrated) so that the blade 88 and its pin 86 can be lifted (or lowered) rotated the 180 degrees and then released and returned back to position under the spring loading, etc.).

If the blade 88 needs to be lifted up, either partially or fully out of the water, then the handle 108 is pulled upwardly causing the lift cable 100 to pull upwardly on and lifting the holding tube 84 as the outrigger bars 80 are pivotally attached to the connector bar 72. If desired, the handle 108 is seated within the saddle 112 of the holder 110 in order to hold the blade 88 out of the water for extended periods of time. When the blade 88 is to be lowered, the handle 108 is lowered (removed from the saddle 112, if necessary) causing the lift cable 100 to lower the holding tube 84 back down. In the lower most position, the cross bar 82 connecting the lower outrigger bars 80 sits on the lip 76 of the tail 74.

While the invention has been particularly shown and described with reference to an embodiment thereof, it will be appreciated by those skilled in the art that various changes in form and detail may be made without departing from the spirit and scope of the invention.

I claim:

1. A pedal powered craft comprising:

a vessel having a forward end and an aft end joined by a port side and a starboard side with a longitudinal midline axis extending between the forward end and the aft end;

a paddle structure attached to the vessel and capable of pivoting about a vertical axis that passes through the midline axis such that a paddle blade of the paddle structure is capable of radially swishing back and forth on either side of the midline axis;

a port pedal structure attached to the vessel on the port of the midline axis and capable of reciprocating back and forth toward the forward end and the aft end;

a starboard pedal structure attached on the starboard of the midline axis and having a starboard pedal capable of reciprocating back and forth toward the forward end and the aft end, such that both the port pedal structure and the starboard pedal structure are equidistant to the midline axis on their respective side and such that when the port pedal of the port pedal structure and the starboard pedal of the starboard pedal structure are each aligned with one another, they are located equidistant from the forward end;

a first cable having a first end attached to the port pedal structure and a second end attached to the paddle structure to the port of the vertical axis;

a second cable having a third end attached to the starboard pedal structure and a fourth end attached to the paddle structure to the starboard of the vertical axis;

a pulley located on the midline axis and forward of the port pedal structure and the starboard pedal structure;

a third cable having a fifth end attached to the port pedal structure and a sixth end attached to the starboard pedal structure such that the third cable passes over the pulley; and wherein whenever the port pedal and the starboard pedal are aligned, the paddle blade is located on the midline axis and such that as the port pedal and the starboard pedal are each reciprocated back and forth in opposing direction to one another, the paddle blade swishes back and forth.

2. The pedal powered craft as in claim 1 wherein the port pedal structure has a port radial guide with a first outer radial groove thereon and the starboard pedal structure has a starboard radial guide with a second outer radial groove thereon such that the first cable passes through the first groove, the second cable passes through the second groove, and the third cable passes through both the first groove and the second groove.

3. The pedal powered craft as in claim 2 wherein the paddle structure is comprised of:

a flywheel having a half-moon shaped power guide with a third groove and a connector bar that forms the base of the power guide such that a first pin passes through the connector bar in order to pivotally attach the paddle structure to the vessel;

an outrigger structure extending rearwardly from the connector bar in a direction opposite to the direction of the power guide; and a second pin that attaches the paddle blade to the outrigger structure.

4. The pedal powered craft as in claim 3 wherein the outrigger structure is pivotally attached to the connector bar and is capable of pivoting between a raised position and a lowered position such that when the outrigger structure is in the lowered position, the outrigger structure rests on a lip located on a tail that extends from the connector bar.

5. The pedal powered craft as in claim 4 further comprising:

a first resilient member connected to the second pin and to the outrigger structure to the port of the midline axis whenever the paddle blade is on the midline axis; and a second resilient member connected to the second pin and to the outrigger structure to the starboard of the midline axis whenever the paddle blade is on the midline axis.

6. The pedal powered craft as in claim 5 wherein the first resilient member is a first spring and the second resilient member is a second spring.

7. The pedal powered craft as in claim 5 wherein the first resilient member is a first resilient cord and the second resilient member is a second resilient cord.

8. The pedal powered craft as in claim 5 wherein the first resilient member is a both a first spring and a first resilient cord and the second resilient member is both a second spring and a second resilient cord.

9. The pedal powered craft as in claim 8 wherein the paddle blade is capable of being rotated 180 degrees.

10. The pedal powered craft as in claim 9 further comprising a seat located on the vessel such that the seat is positioned so as to allow an operator sitting in the seat to be able to reach the port pedal structure and the starboard pedal structure.

11. The pedal powered craft as in claim 1 wherein the port pedal structure has a port radial guide with a first outer radial groove thereon and the starboard pedal structure has a starboard radial guide with a second outer radial groove thereon such that the first cable passes through the first groove and the second cable passes through the second groove.

12. The pedal powered craft as in claim 1 wherein the paddle structure is comprised of:

a flywheel having a half-moon shaped power guide with a third groove and a connector bar that forms the base of the power guide such that a first pin passes through the connector bar in order to pivotally attach the paddle structure to the vessel;

an outrigger structure extending rearwardly from the connector bar in a direction opposite to the direction of the power guide; and a second pin that attaches the paddle blade to the outrigger structure.

13. The pedal powered craft as in claim 12 wherein the outrigger structure is pivotally attached to the connector bar and is capable of pivoting between a raised position and a lowered position such that when the outrigger structure is in the lowered position, the outrigger structure rests on a lip located on a tail that extends from the connector bar.

14. The pedal powered craft as in claim 12 further comprising:

a first resilient member connected to the second pin and to the outrigger structure to the port of the midline axis whenever the paddle blade is on the midline axis; and a second resilient member connected to the second pin and to the outrigger structure to the starboard of the midline axis whenever the paddle blade is on the midline axis.

15. The pedal powered craft as in claim 14 wherein the first resilient member is a first spring and the second resilient member is a second spring.

16. The pedal powered craft as in claim 14 wherein the first resilient member is a first resilient cord and the second resilient member is a second resilient cord.

17. The pedal powered craft as in claim 14 wherein the first resilient member is a both a first spring and a first resilient cord and the second resilient member is both a second spring and a second resilient cord.

18. The pedal powered craft as in claim 1 wherein the paddle blade is capable of being rotated 180 degrees.

19. The pedal powered craft as in claim 1 further comprising a seat located on the vessel such that the seat is positioned so as to allow an operator sitting in the seat to be able to reach the port pedal structure and the starboard pedal structure.

20. A pedal powered craft comprising:

a vessel having a forward end and an aft end joined by a port side and a starboard side with a longitudinal midline axis extending between the forward end and the aft end;

a paddle structure attached to the vessel and capable of pivoting about a vertical axis that passes through the midline axis such that a paddle blade of the paddle structure is capable of radially swishing back and forth on either side of the midline axis;

a port pedal structure attached to the vessel on the port of the midline axis and capable of reciprocating back and forth toward the forward end and the aft end;

a starboard pedal structure attached on the starboard of the midline axis and having a starboard pedal capable of reciprocating back and forth toward the forward end and the aft end, such that both the port pedal structure and the starboard pedal structure are equidistant to the midline axis on their respective side and such that when the port pedal of the port pedal structure and the starboard pedal of the starboard pedal structure are each aligned with one another, they are located equidistant from the forward end;

a first cable having a first end attached to the port pedal structure and a second end attached to the paddle structure to the port of the vertical axis;

a second cable having a third end attached to the starboard pedal structure and a fourth end attached to the paddle structure to the starboard of the vertical axis; and wherein whenever the port pedal and the starboard pedal are aligned, the paddle blade is located on the midline axis and such that as the port pedal and the starboard pedal are each reciprocated back and forth in opposing direction to one another, the paddle blade swishes back and forth and wherein the port pedal structure has a port radial guide with a first outer radial groove thereon and the starboard pedal structure has a starboard radial guide with a second outer radial groove thereon such that the first cable passes through the first groove and the second cable passes through the second groove.

21. A pedal powered craft comprising:

a vessel having a forward end and an aft end joined by a port side and a starboard side with a longitudinal midline axis extending between the forward end and the aft end;

a paddle structure attached to the vessel and capable of pivoting about a vertical axis that passes through the midline axis such that a paddle blade of the paddle structure is capable of radially swishing back and forth on either side of the midline axis;

a port pedal structure attached to the vessel on the port of the midline axis and capable of reciprocating back and forth toward the forward end and the aft end;

a starboard pedal structure attached on the starboard of the midline axis and having a starboard pedal capable of reciprocating back and forth toward the forward end and the aft end, such that both the port pedal structure and the starboard pedal structure are equidistant to the midline axis on their respective side and such that when the port pedal of the port pedal structure and the starboard pedal of the starboard pedal structure are each aligned with one another, they are located equidistant from the forward end;

a first cable having a first end attached to the port pedal structure and a second end attached to the paddle structure to the port of the vertical axis;

a second cable having a third end attached to the starboard pedal structure and a fourth end attached to the paddle structure to the starboard of the vertical axis;

a flywheel having a half-moon shaped power guide with a third groove and a connector bar that forms the base of the power guide such that a first pin passes through the connector bar in order to pivotally attach the paddle structure to the vessel;

an outrigger structure extending rearwardly from the connector bar in a direction opposite to the direction of the power guide; and a second pin that attaches the paddle blade to the outrigger structure; and wherein whenever the port pedal and the starboard pedal are aligned, the paddle blade is located on the midline axis and such that as the port pedal and the starboard pedal are each reciprocated back and forth in opposing direction to one another, the paddle blade swishes back and forth.

22. The pedal powered craft as in claim 21 wherein the outrigger structure is pivotally attached to the connector bar and is capable of pivoting between a raised position and a lowered position such that when the outrigger structure is in the lowered position, the outrigger structure rests on a lip located on a tail that extends from the connector bar.

23. The pedal powered craft as in claim 21 further comprising:

a first resilient member connected to the second pin and to the outrigger structure to the port of the midline axis whenever the paddle blade is on the midline axis; and a second resilient member connected to the second pin and to the outrigger structure to the starboard of the midline axis whenever the paddle blade is on the midline axis.

24. The pedal powered craft as in claim 23 wherein the first resilient member is a first spring and the second resilient member is a second spring.

25. The pedal powered craft as in claim 23 wherein the first resilient member is a first resilient cord and the second resilient member is a second resilient cord.

26. The pedal powered craft as in claim 23 wherein the first resilient member is a both a first spring and a first resilient cord and the second resilient member is both a second spring and a second resilient cord.

* * * * *